US010265966B2

(12) United States Patent
Kondo et al.

(10) Patent No.: US 10,265,966 B2
(45) Date of Patent: Apr. 23, 2019

(54) PRINTING APPARATUS

(71) Applicant: Brother Kogyo Kabushiki Kaisha, Nagoya-shi, Aichi-ken (JP)

(72) Inventors: Tomohiro Kondo, Nagoya (JP); Yasuhiro Torii, Chiryu (JP); Kohei Terada, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/716,590

(22) Filed: Sep. 27, 2017

(65) Prior Publication Data

US 2018/0281455 A1 Oct. 4, 2018

(30) Foreign Application Priority Data

Mar. 30, 2017 (JP) ..... 2017-067063

(51) Int. Cl.

| | |
|---|---|
| ***B41J 2/365*** | (2006.01) |
| ***B41J 2/375*** | (2006.01) |
| ***B41J 2/355*** | (2006.01) |
| *B41J 2/335* | (2006.01) |

(52) U.S. Cl.

CPC ..... *B41J 2/375* (2013.01); *B41J 2/3558* (2013.01); *B41J 2/365* (2013.01); *B41J 2/335* (2013.01)

(58) Field of Classification Search

CPC . B41J 2/365; B41J 2/375; B41J 2/3558; B41J 2/335

See application file for complete search history.

(56) References Cited

U.S. PATENT DOCUMENTS

| | | | | |
|---|---|---|---|---|
| 5,874,982 A * | 2/1999 | Ueda | B41J 2/365 347/194 |
| 6,109,718 A * | 8/2000 | Murakami | B41J 2/04528 347/14 |
| 2007/0008381 A1* | 1/2007 | Cheng | B41J 2/04515 347/61 |

FOREIGN PATENT DOCUMENTS

| | | | |
|---|---|---|---|
| JP | S62-053168 U | 4/1987 | |
| JP | S63-098474 A | 4/1988 | |
| JP | 2001-315374 | * 11/2001 | B41J 2/365 |
| JP | 2001-315374 A | 11/2001 | |

* cited by examiner

*Primary Examiner* — Huan H Tran
(74) *Attorney, Agent, or Firm* — Banner & Witcoff, Ltd.

(57) ABSTRACT

A printing apparatus includes: a main-body having a space therein; a thermal head arranged on a substrate provided in the space, the thermal head having heating elements arranged along a predetermined arrangement direction; a conveyor which conveys a thermal paper along a conveyance path provided in the space and intersecting with the arrangement direction; a first temperature sensor provided in a first space in the space on a side of the thermal head with respect to the conveyance path; a second temperature sensor provided in a second space in the space on a side opposite to the thermal head with respect to the conveyance path; and a processor configured to: correct an amount of applying energy to be applied to the heating elements, based on first and second temperatures detected by the first and second temperature sensors; and apply corrected amount of the applying energy selectively to the heating elements.

20 Claims, 5 Drawing Sheets

PRINTING APPARATUS

CROSS REFERENCE TO RELATED APPLICATION

The present application claims priority from Japanese Patent Application No. 2017-067063 filed on Mar. 30, 2017, the disclosure of which is incorporated herein by reference in its entirety.

BACKGROUND

Field of the Invention

The present invention relates to a printing apparatus.

Description of the Related Art

A printing apparatus in which an energy is applied to a heating element of a thermal head, and printing is carried out by imparting heat to a printing medium by the heating element that has generated heat has been known (For example, Japanese Patent Application Laid-open No. 2001-315374). In a printing apparatus of this type, in a case where an amount of energy (hereinafter, referred to as "applying energy") to be applied to the heating element is excessively small, there is a possibility that characters printed are faint and patchy. In a case where the amount of applying energy is excessively large, there is a possibility that the characters printed are blurred. In such manner, in a case where the amount of applying energy is inappropriate, there is a possibility that there arises a printing defect.

It has been known that when temperature of the thermal head and temperature of the printing medium which is heated by the heating element at the time of printing are identified, it is possible to correct with high accuracy the amount of applying energy. Practically, it is difficult to detect directly the temperature of the printing medium which is conveyed during printing. For example, in a thermal printer described in Japanese Patent Application Laid-open No. 2001-315374, a thermal head temperature sensor is provided for a thermal head. The thermal head temperature sensor detects the temperature of the thermal head. An ambient temperature sensor is provided for an interior of a main-body case. The ambient temperature sensor detects temperature of the interior of the main-body case instead of the temperature of the printing medium. The thermal printer corrects the amount of applying energy, based on the temperature of the thermal head and the temperature of the interior of the main-body case.

SUMMARY

In the thermal printer, since the ambient temperature sensor is provided on the side of the thermal head with respect to the printing medium, an effect of heat from the thermal head on the ambient temperature sensor is substantial. In this case, there arises deviation between change in the temperature detected by the ambient temperature sensor and change in the temperature of the printing medium, and there is a possibility that an accuracy of correcting the amount of applying energy is degraded.

An object of the present teaching is to provide a printing apparatus which is capable of correcting with high accuracy, the amount of energy to be applied.

According to an aspect of the present teaching, there is provided a printing apparatus, including: a main-body having a space at an interior thereof; a thermal head arranged on a substrate provided in the space, the thermal head having heating elements arranged along a predetermined arrangement direction; a conveyor configured to convey a thermal paper along a conveyance path, the conveyance path being provided in the space and intersecting with the arrangement direction; a first temperature sensor provided in a first space in the space, the first space being on a side of the thermal head with respect to the conveyance path; a second temperature sensor provided in a second space in the space, the second space being on a side opposite to the thermal head with respect to the conveyance path; and a processor configured to: correct an amount of applying energy to be applied to the heating elements, based on a first temperature detected by the first temperature sensor and a second temperature detected by the second temperature sensor; and apply corrected amount of the applying energy selectively to the heating elements to cause the heating elements to generate heat, and carry out printing by heating the thermal paper with the heat generated.

In the printing apparatus according to the aspect of the present teaching, the applying energy is corrected based on the first temperature and the second temperature. In the space at the interior of the main body, since the first temperature sensor is provided in the first space on the side of the thermal head with respect to the conveyance path, an effect of heat from the thermal head on the first temperature sensor becomes large. Consequently, deviation between change in the first temperature and change in temperature of the thermal head becomes small. In the space at the interior of the main body, since the second temperature sensor is provided in the second space on a side opposite to the side of the thermal head with respect to the conveyance path, an effect of heat from the thermal head on the second temperature sensor becomes small. Consequently, deviation between change in the second temperature and change in the temperature of the thermal paper becomes small. Therefore, the printing apparatus is capable of correcting with high accuracy, the amount of applying energy.

DESCRIPTION OF THE EMBODIMENTS

An embodiment of the present teaching will be described below by referring to accompanying diagrams. A printing apparatus 1 is connectable to an external terminal (omitted in the diagram) via a USB (registered trademark) cable. The printing apparatus 1 is capable of printing characters such as alphabets and figures on a thermal paper 61 (refer to FIG. 2) on the basis of print data received from the external terminal. The external terminal is a general purpose personal computer (PC). The printing apparatus 1 can be driven by a battery. A lower right side, an upper left side, an upper right side, a lower left side, an upper side, and a lower side in FIG. 1 will be defined as a right side, a left side, a rear side, a front side, an upper side, and a lower side respectively, of the printing apparatus 1.

Figure 1:
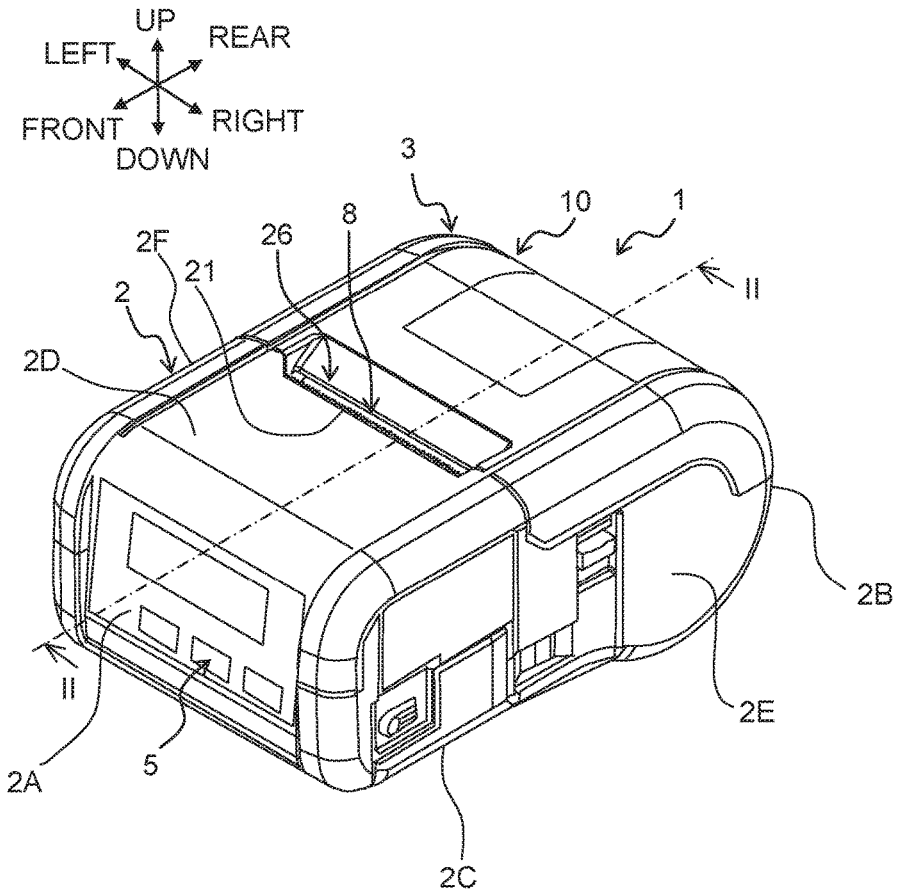
FIG. 1 is a perspective view of a printing apparatus.

A mechanical configuration of the printing apparatus 1 will be described below by referring to FIG. 1 and FIG. 2. As depicted in FIG. 1, the printing apparatus 1 includes a main body 10. The main body 10 is formed to be substantially rectangular-parallelepiped box-shaped, and has a space 4 at an interior (refer to FIG. 2). More elaborately, the main body 10 includes a first cover 2 and a second cover 3. The first cover 2 includes a front wall 2A, a rear wall 2B, a lower wall 2C, an upper wall 2D, a right wall 2E, and a left wall 2F. Each of the front wall 2A, the rear wall 2B, the lower wall 2C, the upper wall 2D, the right wall 2E, and the left wall 2F is in the form of a substantially rectangular-shaped plate. The upper wall 2D is extended rearward from an upper-end portion of the front wall 2A up to a substantially central portion in a front-rear direction of the main body 10. The rear wall 2B is extended upward from a rear-end portion of the lower wall 2C up to a substantially central portion in an up-down direction of the main body 10. The second cover 3 is extended from an upper-end portion of the rear wall 2B up to the proximity of a rear-end portion of the upper wall 2D.

An input unit 5 is provided for the front wall 2A. The input unit 5 includes switches for inputting various information to the printing apparatus 1, and includes a power-supply switch which starts-up the printing apparatus 1. A cutting blade 21 is provided for a rear-end portion of the upper wall 2D. The cutting blade 21 is capable of cutting-off a portion of the thermal paper 61 on which the printing has been carried out. The cutting blade 21 is extended in the left-right direction between the proximity of the right wall 2E and the proximity of the left wall 2F.

The second cover 3 is openable and closable with respect to an accommodating portion 7 to be described later, with an upper-end portion of the rear wall 2B as an axis (refer to FIG. 2). When the second cover 3 is in a state of being closed with respect to the accommodating portion 7 (hereinafter, referred to as "closed state"), the second cover 3 covers the accommodating portion 7 from an upper side. When the second cover 3 is in a state of being opened with respect to the accommodating portion 7 (hereinafter, referred to as "open state"), the accommodating portion 7 is open to the upper side (omitted in the diagram). A platen roller 8 is rotatably supported at a front-end portion of the second cover 3. An axis of rotation of the platen roller 8 is extended in the left-right direction.

Figure 2:
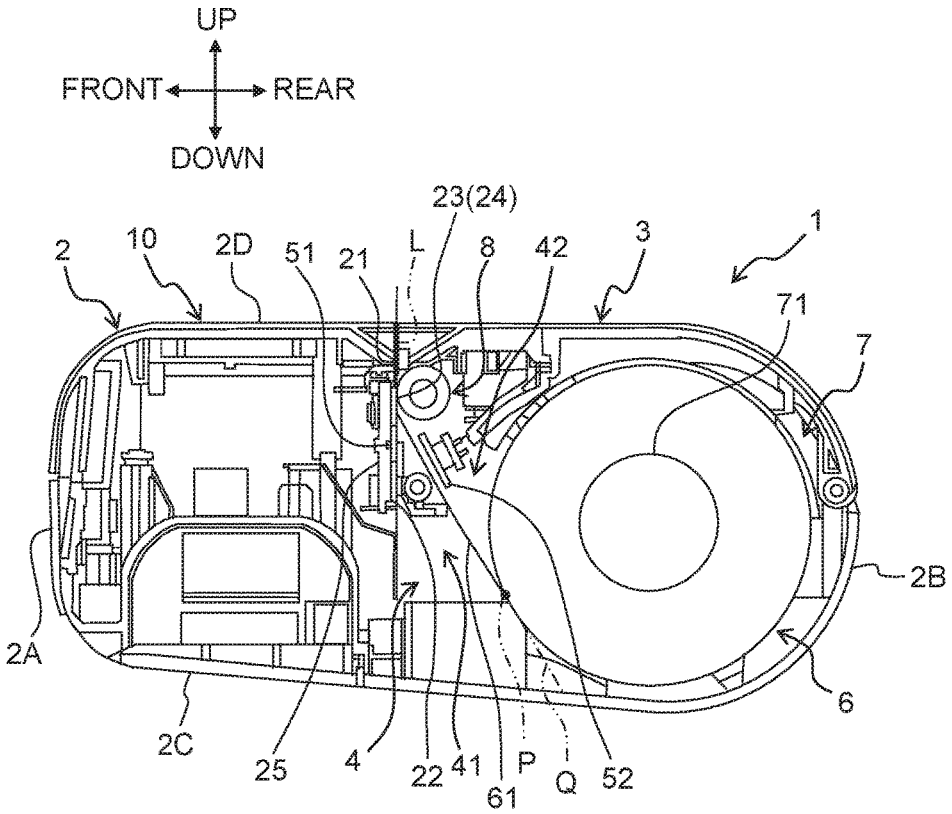
FIG. 2 is a cross-sectional view of the printing apparatus when a cross-section along a line II-II of the printing apparatus in FIG. 1 is viewed in a direction of arrow.

As depicted in FIG. 2, the accommodating portion 7 is provided for substantial rear half portion of the space 4, and opens upward. A roll 6 is detachably accommodated in the accommodating portion 7. The roll 6 is a source of supply of the thermal paper 61, and is formed by the thermal paper 61, that is connected continuously, being wound around a tubular core. In the present embodiment, the roll 6 is wound in a clockwise direction in a right side view, from a trailing end of the thermal paper 61 up to a leading end (an end portion on an opposite side of the trailing end). A pair of supporting portions 71 is fixed to the accommodating portion 7. The pair of supporting portions 71 is a pair of shaft portions extended in the left-right direction, and the shaft portions are provided for the right wall 2E and the left wall 2F respectively. The pair of supporting portions 71 is inserted into the core of the roll 6, and rotatably supports the roll 6 from both the left side and the right side. The roll 6 is accommodated in the accommodating portion 7 in a state of being supported by the pair of supporting portions 71.

In the space 4, a substrate 22 is provided below the cutting blade 21. A thermal head 23 is arranged near an upper-end portion of a rear surface of the substrate 22. The thermal head 23 is extended in the left-right direction between the proximity of the right wall 2E and the proximity of the left wall 2F. A length of the thermal head 23 in the left-right direction is substantially equal to the maximum width (a length in the left-right direction) of the roll 6 (thermal paper 61) that can be accommodated in the accommodating portion 7. The thermal head 23 includes a plurality of heating elements 24 arranged along the left-right direction. The heating elements 24 generate heat when energy is applied. A heat sink 25 is provided for a front surface of the substrate 22. The heat sink 25 releases heat of the heating elements 24 which have generated heat. More elaborately, the heat of the heating elements 24 is transmitted to the heat sink 25 via the substrate 22. The heat sink 25 releases the heat transferred via the substrate 22, to an outside (outside air) of the printing apparatus 1.

In the arrangement described above, the user sets (attaches) and removes (detaches) the roll 6 while the second cover 3 is in the open state. In a state of the roll 6 accommodated in the accommodating portion 7, a width direction of the roll 6 (thermal paper 61) is the left-right direction. When the second cover 3 is in the closed state, the thermal head 23 and the platen roller 8 come closer mutually. In a case where the thermal paper 61 is arranged between the thermal head 23 and the platen roller 8, the platen roller 8 presses the thermal paper 61 toward the thermal head 23. The platen roller 8, by being rotated by a drive of a conveyance motor 88 (refer to FIG. 3), draws the thermal paper 61 from the roll 6, and conveys the thermal paper 61 while pressing against the thermal head 23. The thermal head 23 prints characters in the units of lines on the thermal paper 61 by the heating elements 24 selectively generating the heat. When the second cover 3 is in the closed state, a discharge port 26 is formed between the cutting blade 21 and the platen roller 8. The discharge port 26 discharges the thermal paper 61 subjected to printing at an interior (the space 4) of the printing apparatus 1, to the outside of the printing apparatus 1.

In the following description, a point at which the thermal paper 61 is drawn from the roll 6 is defined as a "drawing point P". A path along a conveying direction of the thermal paper 61 conveyed by the platen roller 8 is defined as a "conveyance path L". In the present embodiment, the drawing point P is at a lower-front side of the roll 6. The conveyance path L is extended from the drawing point P toward the thermal head 23, to be inclined upward and frontward in a right-side view, and is extended upward from the thermal head 23 toward the discharge port 26. The conveyance path L is orthogonal to the direction in which the plurality of heating elements 24 is arranged (in other words, the left-right direction). In the following description, in the space 4, a space on a side of the thermal head 23 (in other words, the front side) with respect to the conveyance path L is defined as a "first space 41". In the space 4, a space on a side opposite to the thermal head 23 (in other words, the rear side) with respect to the conveyance path L is defined as a "second space 42". With the conveyance path L extended in a direction opposite to the direction in which the conveyance path L is extended from the drawing point P, and a virtual plane in which the extended conveyance path L is extended in the width direction of the thermal paper 61 (the left-right direction) is defined as a "virtual plane Q". The first space 41 and the second space 42 are demarcated by the virtual plane Q.

A first thermistor 51 is provided in the first space 41. In the present embodiment, the first thermistor 51 is provided to a central portion of the rear surface of the substrate 22 (in other words, to a lower side of the thermal head 23). The first thermistor 51 is a temperature sensor which is capable of detecting temperature. More elaborately, the first thermistor 51 detects temperature of the substrate 22 and temperature of the heat sink 25. In the present embodiment, the temperature of the substrate 22 and the temperature of the heat sink 25 are treated to be equal.

A second thermistor 52 is provided in the second space 42. In the present embodiment, the second thermistor 52 is provided for the conveyance path L on an upstream side of the plurality of heating elements 24 (printing position). In other words, the second thermistor 52 is provided at a lower side of a virtual surface extended in the front-rear direction, through the plurality of heating elements 24. More elaborately, the second thermistor 52 is provided near the conveyance path L, at a lower side of the platen roller 8. The second thermistor 52 is provided at an inner side of the width of the thermal paper 61 in the left-right direction, in a state that the roll 6 (thermal paper 61) having the maximum width that can be accommodated in the accommodating portion 7 is accommodated in the accommodating portion 7. The second thermistor 52 is provided within the width of the thermal head 23, in the left-right direction. In the present embodiment, the second thermistor 52 is provided for a substantially central portion in the left-right direction of the second space 42, and is facing the rear surface of the substrate 22 in the front-rear direction. The second thermistor 52 is a temperature sensor which is capable of detecting temperature. More elaborately, the second thermistor 52 detects ambient temperature of the second space 42. The pair of supporting portions 71 is arranged in the second space 42. In other words, the roll 6 accommodated in the accommodating portion 7 in a state of being supported by the pair of supporting portions 71 is arranged in the second space 42.

Figure 3:
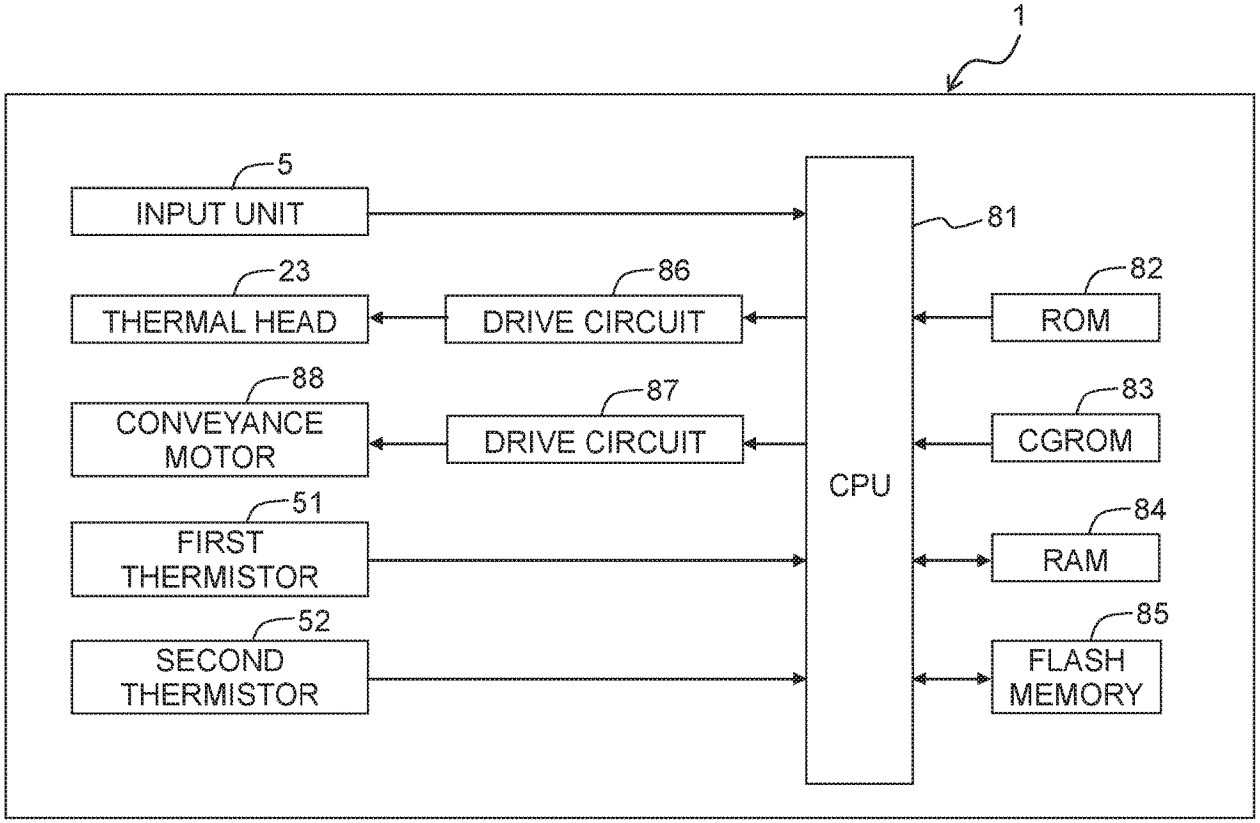
FIG. 3 is a block diagram depicting an electrical configuration of the printing apparatus.

An electrical configuration of the printing apparatus 1 will be described below by referring to FIG. 3. The printing apparatus 1 includes a CPU (central processing unit) 81 which carries out an integrated control of the printing apparatus 1. The CPU 81 is connected to a ROM (read only memory) 82, a CGROM (character generator read only memory) 83, a RAM (random access memory) 84, a flash memory 85, the input unit 5, drive circuits 86 and 87, the first thermistor 51, and the second thermistor 52.

The ROM 82 stores various parameters that are necessary when the CPU 81 executes various computer programs. Print data for test printing for example (hereinafter, referred to as "test print data") and design parameters that will be described later are stored in the ROM 82. In the present embodiment, for identifying media parameters that will be described later, a test printing is carried out before carrying out normal printing. The test print data includes print data of a plurality of patterns that have been determined in advance for carrying out printing in which the media parameters can be identified. The CGROM 83 stores dot-pattern data for printing characters. The RAM 84 includes a plurality of storage area such as a text memory and print buffer. The flash memory 85 stores various computer programs which the CPU 81 executes for controlling the printing apparatus 1. Print data acquired from an external terminal for example is stored in the flash memory 85. The drive circuit 86 is an electronic circuit for driving the thermal head 23. The drive circuit 87 is an electronic circuit for driving the conveyance motor 88.

In the present embodiment, the CPU 81, on the basis of the print data, applies energy selectively to the plurality of heating elements 24. The CPU 81 corrects an amount of the energy to be applied (hereinafter, referred to as "applying energy") to the plurality of heating elements 24. Accordingly, the printing apparatus 1 is capable of reducing a printing defect. In a case of correcting the amount of applying energy, information of temperature of the plurality of heating elements 24 and information of temperature of the thermal paper 61 are necessary. The printing apparatus of the present embodiment acquires the information necessary for correcting the applying energy as described below.

An equation of state that is established in a system including n number of elements (here, n is a natural number) will be described. Variables, vectors, and matrices to be used in the following description will be described below. In the following description, t is a variable and denotes time. Moreover, $T_k(t)$ is a vector which includes n real numbers, and is a function of t. Here, $T_k(t)$ denotes temperature of $k^{th}$ (k=1, 2, 3, . . . ) element. Moreover, $T_k(0)$ denotes an initial value of temperature. Furthermore, A is a matrix including real numbers of n rows and n columns, and indicates relationship of flow of heat for each element. More elaborately, A denotes a thermal capacity, a coefficient of heat transfer, and a heat transfer pathway of each element. B is a matrix including real numbers of n rows and m columns, and corrects the equation. Moreover, u(t) is a vector which includes m real numbers, and is a function of t. Furthermore, u(t) indicates an amount of energy that is inputted to the system. Moreover, $T_{airZ}$ denotes an ambient temperature outside the system, and is let to be constant.

When the energy u(t) is inputted to the system, there is transfer of heat between elements, and between each element and an atmosphere outside the system. In this case, expression (1) expressed by a simultaneous differential equation on the basis of modern control theory is established.

[Expression 1]

$$\frac{d}{dt}\begin{bmatrix} T_1(t) - T_{airZ} \\ \vdots \\ T_n(t) - T_{airZ} \end{bmatrix} = A\begin{bmatrix} T_1(0) - T_{airZ} \\ \vdots \\ T_n(0) - T_{airZ} \end{bmatrix} + Bu(t) \tag{1}$$

By solving expression (1), expression (2) is achieved.

[Expression 2]

$$\begin{bmatrix} T_1(t) - T_{airZ} \\ \vdots \\ T_n(t) - T_{airZ} \end{bmatrix} = e^{At}\begin{bmatrix} T_1(0) - T_{airZ} \\ \vdots \\ T_n(0) - T_{airZ} \end{bmatrix} + \int_0^t e^{A(t-\tau)}Bu(\tau)d\tau \tag{2}$$

In expression (2), A is assumed to be a known number. In other words, $e^{At}$ and a second item on the right-hand side, are assumed to be known values. In this case, the number of unknown values is 2n which includes n number of the initial temperatures ($T_k(0)$) of each element, and n number of the temperatures ($T_k(t)$) at the time t. Expression (2) being a simultaneous expression including n number of equations, when n number of unknown parameters are identified, all the unknown parameters are determined.

When one temperature sensor is arranged for one specific element, two unknown parameters, which are the initial temperature and the temperature at time t, are identified for one element. Therefore, when two temperature sensors are arranged for mutually different elements (positions), four unknown parameters are identified. In this case, when the remaining (n−4) number of unknown parameters are identified, all the unknown parameters are determined.

Expression (2) is to be applied to a system which includes the space 4 of the present embodiment. The system which includes the space 4 of the present embodiment includes five elements (in other words, n=5), for example. More specifically, the five elements are the thermal head 23, the heat sink 25, the atmosphere of the first space 41, the atmosphere of the second space 42, and the thermal paper 61. In this system, when the applying energy is applied to the heating elements 24, a part of the heat of the heating elements 24 flows to the heat sink 25 and the thermal paper 61. The heat flowed to the thermal paper 61 flows to an outside of the system. A part of the heat that has flowed to the heat sink 25 flows to the outside of the system and the first space 41. A part of the heat that has flowed to the first space 41 flows to the second space 42. In the expression to be used in the following description, the thermal head 23 is denoted by h, the heat sink 25 is denoted by hs, the atmosphere of the first space 41 is denoted by airA, the atmosphere of the second space 42 is denoted by airB, and the thermal paper 61 (media) is denoted by m. For example, $T_h(0)$ denotes initial temperature of the thermal head 23. Moreover, $T_{airZ}$ denotes temperature of the atmosphere (ambient air) of the outside of system, and is equal to the initial temperature of the atmosphere of the second space 42 for example. Furthermore, $u(\tau)$ denotes the applying energy at the time $t=\tau$. In this case, expression (3) is established on the basis of expression (2).

[Expression 3]

$$\begin{bmatrix} T_h(t) - T_{airZ} \\ T_{hs}(t) - T_{airZ} \\ T_{airA}(t) - T_{airZ} \\ T_{airB}(t) - T_{airZ} \\ T_m(t) - T_{airZ} \end{bmatrix} = e^{At} \begin{bmatrix} T_h(0) - T_{airZ} \\ T_{hs}(0) - T_{airZ} \\ T_{airA}(0) - T_{airZ} \\ T_{airB}(0) - T_{airZ} \\ T_m(0) - T_{airZ} \end{bmatrix} + \int_0^t e^{A(t-\tau)} Bu(\tau) d\tau \tag{3}$$

In expression (3), A includes design parameters and media parameters. The design parameters are known values determined in advance by design items of the printing apparatus 1. The design parameters, for example, are a thermal capacity of each of the thermal head 23, the heat sink 25, the atmosphere of the first space 41, and the atmosphere of the second space 42, and a coefficient of heat transfer among the thermal head 23, the heat sink 25, the atmosphere of the first space 41, and the atmosphere of the second space 42 when there is a heat transfer therebetween. The coefficient of heat transfer as a design parameter includes a coefficient of heat transfer between the thermal head 23 and the heat sink 25, a coefficient of heat transfer between the heat sink 25 and the first space 41, and a coefficient of heat transfer between the heat sink 25 and the atmosphere of the outside of the system.

The media parameters are unknown values which depend on a type of the thermal paper 61 (such as a material, a width, and a thickness of the thermal paper 61). The media parameters include parameters such as a thermal capacity of the thermal paper 61, a coefficient of heat transfer between the thermal paper 61 and the thermal head 23, and a coefficient of heat transfer between the atmosphere of the first space 41 and the atmosphere of the second space 42 which are demarcated by the virtual plane Q. In the present embodiment, the media parameters are identified by the test printing. Accordingly, in expression (3), since A is identified, $e^{At}$ and a second item on a right-hand side of the expression, are known values that can be expressed in terms of t. Therefore, by the test printing, the initial temperature of each element and temperature at the time t of each element are the only unknown parameters in expression (3). Since expression (3) is a simultaneous equation including five equations, when the unknown parameters are not more than five, the printing apparatus is capable of computing all the parameters (the initial temperature and the temperature at the time t of all elements).

In the present embodiment, the printing apparatus 1 includes only two thermistors which are the first thermistor 51 and the second thermistor 52, as temperature sensors to be used for correction of the applying energy. In the printing apparatus 1, by arranging the first thermistor 51 and the second thermistor 52 at specific positions as mentioned above, it is possible to identify approximately, the initial temperature of the thermal paper 61, in addition to be able to identify the temperatures (initial temperature and the temperature at the time t) of two elements. More specifically, from the temperature detected by the first thermistor 51 (hereinafter, referred to as "first temperature"), $T_{hs}(t)$ and $T_{hs}(0)$ are identified. From the temperature detected by the second thermistor 52 (hereinafter, referred to as "second temperature"), $T_m(0)$ is identified approximately in addition to $T_{airB}(t)$ and $T_{airB}(0)$ being identified. As mentioned above, $T_{airZ}$ is equal to $T_{airB}(0)$. Accordingly, the number of unknown parameters in expression (3) becomes five which are $T_h(t)$, $T_h(0)$, $T_{airA}(t)$, $T_{airA}(0)$, and $T_m(t)$. Hereinafter, the five unknown parameters will be collectively referred to as "parameters to be identified". The parameters to be identified, out of the unknown values independent of the type of the thermal paper 61, are variables which cannot be identified only on the basis of the first temperature and also cannot be identified only on the basis of the second temperature. The number of parameters to be identified is five, and since expression (3) is a simultaneous equation including five equations, the printing apparatus 1 is capable of computing all the parameters on the basis of expression (3), by using the temperatures detected by the two thermistors (the first thermistor 51 and the second thermistor 52). Accordingly, the printing apparatus 1 is capable of correcting with high accuracy, the amount of applying energy, on the basis of the parameters computed, while suppressing an increase in the number of thermistors.

Figure 4A:
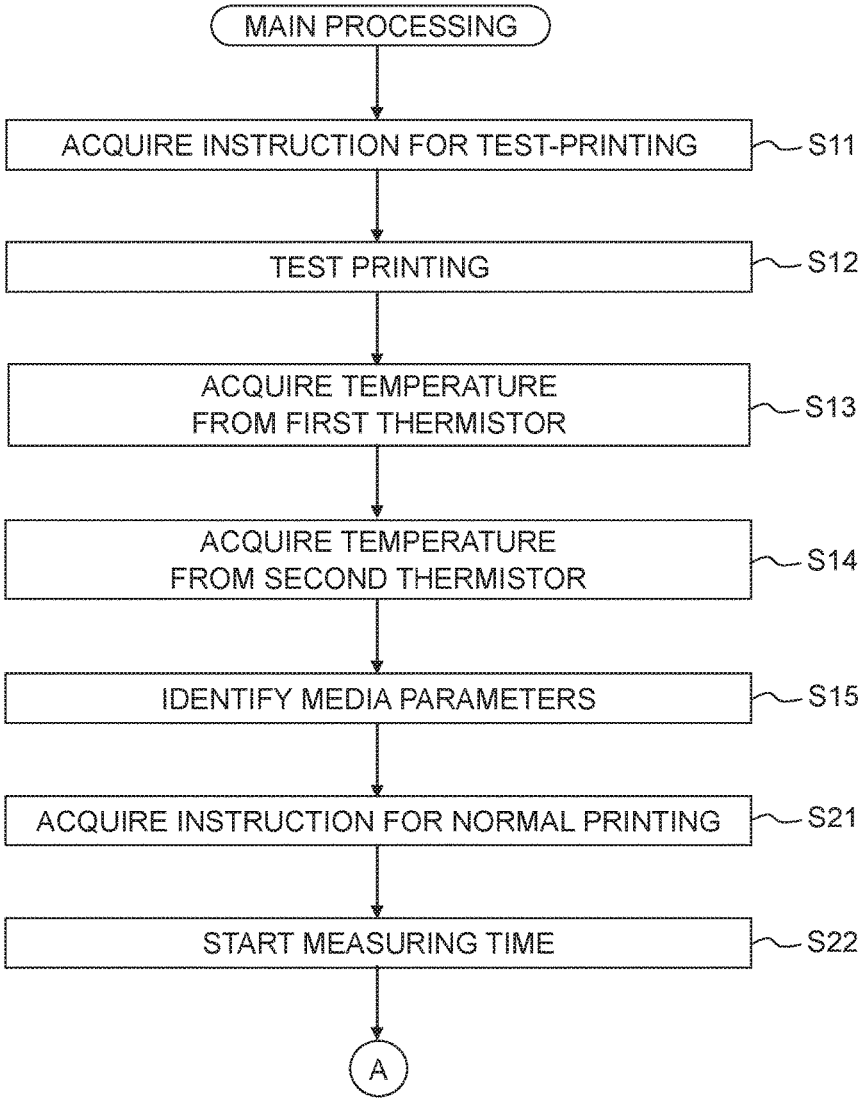
FIGS. 4A and 4B are a flowchart of main processing.
Figure 4B:
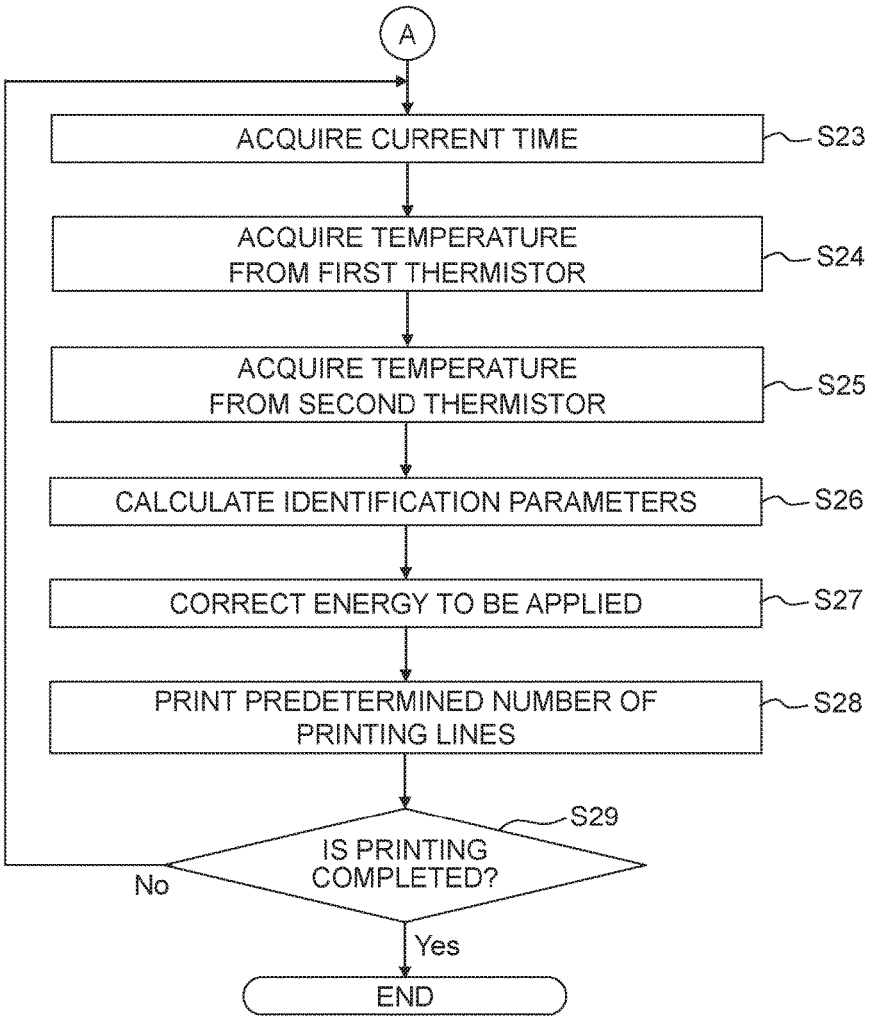

A main processing will be described below by referring to FIGS. 4A and 4B. A user operates a power-supply switch of the input unit 5, and starts-up the printing apparatus 1. When the printing apparatus 1 is started, the CPU 81 starts the main processing by executing a computer program stored in the ROM 82.

In the present embodiment, as mentioned above, the test printing is carried out prior to the normal printing. The user operates the input unit 5 and inputs an instruction for test printing to the CPU 81. The CPU 81 acquires the instruction for test printing inputted by the user (step S11). The CPU 81 reads out test printing data from the ROM 82, and executes the test printing on the basis of the test printing data (step S12). The CPU 81 acquires the first temperature from the first thermistor 51 (step S13). The CPU 81 acquires the second temperature from the second thermistor 52 (step S14). The CPU 81, on the basis of the first temperature and the second temperature acquired at steps S13 and S14, identifies the media parameters approximately (step S15). Accordingly, A in expression (3) is identified. Values of the media parameters identified approximately at step S15 are stored in the RAM 84. An accuracy of identifying the values of the media parameters may be improved by repeating step S12 to S14 for a plurality of times by the CPU 81.

As the test printing is completed, the user inputs an instruction for normal printing to the CPU 81 via the input unit 5. The CPU 81 acquires the instruction for normal printing inputted by the user (step S21). The instruction for normal printing includes the print data. The CPU 81 starts measuring time by a timer counter of the RAM 84 (step S22). The CPU 81 refers to the timer counter of the RAM 84, and acquires a current time (step S23). The current time is denoted by tin expression (3), and is 0 in the initial state (in other words, t=0). The current time acquired at step S23 is stored in the RAM 84.

The CPU 81 acquires the first temperature from the first thermistor 51 (step S24). The CPU 81 acquires the second temperature from the second thermistor 52 (step S25). The temperatures acquired at steps S24 and S25 are stored in the RAM 84. The CPU 81 compute the parameters to be identified on the basis of expression (3), by using the design parameters that have been stored in the ROM 82 in advance, the media parameters stored in the RAM 84 at step S15, the current time (t) stored in the RAM 84 at step S23, and the first temperature and the second temperature stored in the RAM 84 at steps S24 and S25 (step S26). Values of the parameters to be identified computed at step S26 are stored in the RAM 84.

The CPU 81 corrects the amount of the applying energy on the basis of $T_h$ and $T_m$ computed at step S26, by a known method (step S27). The amount of the applying energy that has been corrected at step S27 is stored in the RAM 84. The CPU 81 prints a predetermined number of printing lines on the basis of the applying energy corrected at step S27 (step S28). More elaborately, the CPU 81 controls the conveyance motor 88, and conveys the thermal paper 61 by a length equivalent to the predetermined number of printing lines. The CPU 81, in synchronization with the conveyance of the thermal paper 61 of the length equivalent to the predetermined number of printing lines, applies the amount of applying energy that has been corrected at step S27, to the plurality of heating elements 24 for each printing line. At this time, the CPU 81, on the basis of the printing data, selectively applies the amount of applying energy that has been corrected, to the plurality of heating elements 24, and generates heat. Printing is carried out by heating, on the thermal paper 61, by using the heat elements 24 that have generated heat. Consequently, the printing apparatus 1 is capable of reducing a printing defect caused due to inappropriate amount of applying energy.

The CPU 81 determines whether the printing is to be terminated (step S29). In a case where data of printing lines, that have not been printed yet, has remained in the printing data, the CPU 81 determines not terminating the printing (NO at step S29). The CPU 81 returns the processing to step S23. In other words, the correction of the amount of applying energy (step S27) is carried out for printing of the predetermined number of printing lines every time. Therefore, the smaller the predetermined number (of printing lines), the more improved is the accuracy of correction of the amount of the applying energy. Moreover, the larger the predetermined number (of printing lines), the more lightened is the control load on the CPU 81. In a case where there is no data remained of the printing lines that have not been printed in the printing data, the CPU 81 determines that the printing is to be terminated (YES at step S29). The CPU 81 terminates the main processing.

As described heretofore, the amount of applying energy is corrected on the basis of the first temperature and the second temperature (step S27). It has been known that, as the temperature of the thermal head 23 and the temperature of the thermal paper 61 to which the heat is imparted by the heating elements 24 at the time of printing are identified, it is possible to correct the amount of applying energy with high accuracy. The first thermistor 51 is provided in the first space 41 on the side of the thermal head 23 with respect to the conveyance path L, in the space 4 at the interior of the main body 10. Consequently, an effect of the heat from the thermal head 23 on the first thermistor 51 becomes substantial. Consequently, deviation between change in the first temperature and change in the temperature of the thermal head 23 becomes small. At least a part of the heat that flows from the first space 41 to the second space 42 is blocked by the thermal paper 61 which is in the conveyance path L. Consequently, an effect of the heat from the thermal head 23 on the second space 42 is smaller than an effect of the heat from the thermal head 23 on the first space 41. The second thermistor 52 is provided in the second space 42 which is on the side opposite to the thermal head 23 with respect to the conveyance path L, in the space 4 at the interior of the main body 10. For this reason, an effect of the heat from the thermal head 23 on the second thermistor 52 becomes small. Consequently, deviation between change in the second temperature and change in the temperature of the thermal paper 61 becomes small. Therefore, the printing apparatus 1 is capable of correcting the amount of applying energy with high accuracy. Since the printing is carried out on the basis of the amount of applying energy that has been corrected, the printing apparatus 1 is capable of reducing a printing defect caused due to the applying energy.

Since the supporting portion 71 is provided in the second space 42, an effect of heat from the thermal head 23 on the roll 6 becomes smaller as compared to a case in which the supporting portion 71 is provided in the first space 41. Since, the deviation between the change in the second temperature and the change in the temperature of the thermal paper 61 becomes small, the printing apparatus 1 is capable of correcting the amount of applying energy with high accuracy.

For instance, when printing is carried out on the thermal paper 61, there is an effect of heat from the thermal head 23 on the thermal paper 61. In the printing apparatus 1, since the second thermistor 52 is provided at a position in the second space 42 where the thermal paper 61 on which no printing has been carried out is accommodated, the deviation between the change in the second temperature and the change in the temperature of the thermal paper 61 becomes small. Consequently, the printing apparatus 1 is capable of correcting the amount of applying energy with high accuracy.

The second thermistor 52 is provided within the width of the thermal head 23, in the left-right direction. Since at least a part of radiant heat released from the heating elements 24 is blocked by the thermal paper 61 which is in the conveyance path L, an effect of heat from the thermal head 23 on the second thermistor 52 becomes small. Consequently, the deviation between the change in the second temperature and the change in the temperature of the thermal paper 61 becomes small. As a result, the printing apparatus 1 is capable of correcting the amount of applying energy with high accuracy.

Since the first thermistor 51 is provided on the substrate 22, it is possible to detect the temperature of the substrate 22 with high accuracy. Since the thermal head 23 is arranged on the substrate 22, deviation between the change in the first temperature and the change in the temperature of the thermal head 23 becomes small. Consequently, the printing apparatus 1 is capable of correcting the amount of applying energy with high accuracy.

As the printing is carried out for instance, an amount of the thermal paper 61 decreases (in other words, a diameter of the roll 6 becomes small) Accordingly, a ratio of a proportion of air occupying the space 4 and a proportion of the thermal paper 61 occupying the space 4, changes. Even in this case, since the printing apparatus 1 executes steps S23 to S27 for printing of the predetermined number of printing lines every time, it is possible to show the effect described above.

In the present embodiment, the left-right direction of the printing apparatus 1 corresponds to the "arrangement direction" of the present teaching. The platen roller 8 corresponds to the "conveyor" of the present teaching. The first thermistor 51 corresponds to the "first temperature sensor" of the present teaching. The second thermistor 52 corresponds to the "second temperature sensor" of the present teaching. The roll 6 corresponds to the "supply source" of the present teaching.

It is possible to make various modifications in the embodiment of the present teaching. For instance, in the embodiment, expression (2) was applied upon taking into consideration the five elements which are the thermal head 23, the heat sink 25, the atmosphere of the first space 41, the atmosphere of the second space 42, and the thermal paper 61, as the n number of elements. However, without restricting to five, the number of elements may be six or more than six. For instance, in a case where one element is added to the five elements in the embodiment, expression (4) is established on the basis of expression (2). The element added is denoted by add1.

[Expression 4]

$$\begin{bmatrix} T_h(t) - T_{airZ} \\ T_{hs}(t) - T_{airZ} \\ T_{airA}(t) - T_{airZ} \\ T_{airB}(t) - T_{airZ} \\ T_m(t) - T_{airZ} \\ T_{add1}(t) - T_{airZ} \end{bmatrix} = e^{At} \begin{bmatrix} T_h(0) - T_{airZ} \\ T_{hs}(0) - T_{airZ} \\ T_{airA}(0) - T_{airZ} \\ T_{airB}(0) - T_{airZ} \\ T_m(0) - T_{airZ} \\ T_{add1}(0) - T_{airZ} \end{bmatrix} + \int_0^t e^{A(t-\tau)} Bu(\tau) d\tau \quad (4)$$

In expression (4), $T_{hs}(t)$ and $T_{hs}(0)$ are identified from the first temperature. Moreover, $T_m(0)$ is approximately identified in addition to $T_{airB}(t)$ and $T_{airB}(0)$ being identified from the second temperature. In other words, since five parameters are identified, the number of unknown parameters is seven. Expression (4) being a simultaneous expression including six expressions, when one more unknown parameter can be identified, the printing apparatus 1 is capable of computing all the parameters. Consequently, when it is possible to identify $T_{hs}(t)$, $T_{hs}(0)$, $T_{airB}(t)$, $T_{airB}(0)$, and $T_m(0)$, and when one of the first thermistor 51 and the second thermistor 52 is provided at a position where at least one of $T_{add1}(t)$ and $T_{add1}(0)$ can be identified approximately from either the first temperature or the second temperature, the printing apparatus 1 is capable of computing all the parameters. Without restricting the number of thermistors to two, a third thermistor may be provided to an additional element for instance, of the printing apparatus 1.

In the embodiment, the CPU 81 identifies the media parameters on the basis of the first temperature and the second temperature, by test printing. However, the method of identifying the media parameters is not restricted to the abovementioned method. For instance, a table in which the types of the thermal paper 61 and the media parameters are associated may be stored in the ROM 82. In this case, the CPU 81 may acquire the type of the thermal paper 61 at least before the processing at step S25. The CPU 81 may acquire the type of the thermal paper 61 which has been inputted by the user via the input unit 5. The role 6 may include an identification portion (such as an IC tag) which enables to identify the type of the thermal paper 61. The printing apparatus 1 may include a reading section. The CPU 81 may acquire the type of the thermal paper 61 by reading out the identification portion of the roll 6 via the reading section when the roll 6 has been accommodated in the accommodating portion 7. The CPU 81 may acquire, from the table, the media parameters corresponding to the type of the thermal paper 61 acquired. In this case, it is possible for the printing apparatus 1 to omit the processing at steps S11 to S15, and to save the trouble of test printing.

A position at which the first thermistor 51 is to be provided is not restricted to the substrate 22. The first thermistor 51 may be provided for the heat sink 25 for example, or may be provided for the thermal head 23, or may be provided for another member in the first space 41. The closer the position at which the first thermistor 51 is provided to the thermal head 23, the higher is the accuracy of computing the temperature of the thermal head 23 at step S26 by the CPU 81.

The position at which the second thermistor 52 is to be provided is not restricted to the position in the embodiment. The second thermistor 52 may be provided for the supporting portion 71 for example, or may be provided for the platen roller 8, or may be provided for another member in the second space 42. The second thermistor 52 may be provided outside the width of the thermal paper 61 in the left-right direction, or may be provided on a downstream side of the plurality of heating elements 24 in the conveyance path L. The farther the position at which the second thermistor 52 is arranged, from the thermal head 23, and the nearer the position at which the second thermistor 52 is arranged, to the thermal paper 61, the higher is the accuracy of identifying approximately the temperature of the thermal paper 61 by the printing apparatus 1.

In the printing apparatus 1, another temperature sensor (such as a thermocouple) may be adopted instead of the first thermistor 51 and the second thermistor 52. In the embodiment, the roll 6 is the supply source of the thermal paper 61. However, the supply source of the thermal paper 61 may be a so-called fanfold paper in which the thermal paper 61 which is continuous is folded alternately. In this case, the printing apparatus 1 may include a supporting base which supports the fanfold paper from a lower side, instead of the supporting portion 71. In FIG. 2, the roll 6 may be wound in a counterclockwise direction in a right side view, from a trailing end up to a leading end of the thermal paper 61. In other words, in the embodiment, the supporting portion 71 is provided in the second space 42, but the supporting portion 71 may be provided in the first space 41.

In the present embodiment, the classification of the design parameters and the media parameters is merely an example. In the printing apparatus 1, some or all of the media parameters may be stored in advance in the ROM 82, as known values. Some or all of the design parameters may be treated as unknown values, and the design parameters may be identified by the test printing for example.

Instead of the CPU 81, a microcomputer, an ASIC (application specific integrated circuit), an FPGA (field programmable gate array) etc. may be used as a processor. The main processing may be distributed to a plurality of processors. The flash memory 85 may not include a transitory storage medium (such as a signal to be transmitted). The computer program may be downloaded from a server connected to the network (in other words, transmitted as a transmission signal), or may be stored in the flash memory 85. In this case, it is preferable that the computer program is saved in a non-transitory storage medium such as an HDD (hard disc drive) in a server.

What is claimed is:

1. A printing apparatus, comprising:

a main-body having a space at an interior thereof;

a thermal head arranged on a substrate provided in the space, the thermal head having heating elements arranged along an arrangement direction;

a supply source of a printing medium, the supply source being provided in the space;

a discharge port through which the space and outside of the main-body communicate with each other;

a conveyor configured to convey the printing medium along a conveyance path, the conveyance path connecting the supply source and the discharge port and intersecting with the arrangement direction;

a first temperature sensor and a second temperature sensor provided in the space; and a processor configured to:

correct an amount of applying energy to be applied to the heating elements, based on a first temperature detected by the first temperature sensor and a second temperature detected by the second temperature sensor; and apply a corrected amount of the applying energy selectively to the heating elements to cause the heating elements to generate heat, and carry out printing by heating the printing medium with the heat generated, wherein the space is divided into a first space and a second space by a virtual plane along the conveyance path extending from the supply source to the discharge port, wherein the first temperature sensor is provided in the first space, and wherein the second temperature sensor is provided in the second space.

2. The printing apparatus according to claim 1, further comprising a supporting portion provided in the second space and configured to support the supply source of the printing medium, wherein the printing medium is continuous.

3. The printing apparatus according to claim 1, wherein the second temperature sensor is provided on an upstream side of the heating elements in the conveyance path.

4. The printing apparatus according to claim 1, wherein the second temperature sensor is provided within a width of the thermal head, with respect to the arrangement direction.

5. The printing apparatus according to claim 1, further comprising a heat sink provided on the substrate and configured to release the heat of the heating elements, wherein the first temperature sensor is provided on one of the substrate and the heat sink.

6. A printing apparatus, comprising:

a main-body having a space at an interior thereof, the space being separated into a first space and a second space by a virtual plane;

a thermal head arranged on a substrate provided in the space, the thermal head having heating elements arranged along an arrangement direction;

a supply source of a printing medium, the supply source being provided on the virtual plane in the space;

a discharge port through which the space and outside of the main-body communicate with each other, the discharge port being positioned on the virtual plane;

a conveyor configured to convey the printing medium along a conveyance path, the conveyance path connecting the supply source and the discharge port along the virtual plane and intersecting with the arrangement direction;

a first temperature sensor provided in the first space;

a second temperature sensor provided in the second space; and a processor configured to:

correct an amount of applying energy to be applied to the heating elements, based on a first temperature detected by the first temperature sensor and a second temperature detected by the second temperature sensor; and apply a corrected amount of the applying energy selectively to the heating elements to cause the heating elements to generate heat, and carry out printing by heating the printing medium with the heat generated.

7. The printing apparatus according to claim 6, further comprising a supporting portion provided in the second space and configured to support the supply source of the printing medium, wherein the printing medium is continuous.

8. The printing apparatus according to claim 6, wherein the second temperature sensor is provided on an upstream side of the heating elements in the conveyance path.

9. The printing apparatus according to claim 6, wherein the second temperature sensor is provided within a width of the thermal head, with respect to the arrangement direction.

10. The printing apparatus according to claim 6, further comprising a heat sink provided on the substrate and configured to release the heat of the heating elements, wherein the first temperature sensor is provided on one of the substrate and the heat sink.

11. A printing apparatus, comprising:

a main-body having an accommodating portion of a printing medium and a discharge port of the printing medium;

a thermal head arranged on a substrate provided inside the main-body, the thermal head having heating elements arranged along an arrangement direction;

a conveyor configured to convey the printing medium along a conveyance path from the accommodating portion to the discharge port;

a first temperature sensor;

a second temperature sensor; and a processor configured to:

correct an amount of applying energy to be applied to the heating elements, based on a first temperature detected by the first temperature sensor and a second temperature detected by the second temperature sensor; and apply a corrected amount of the applying energy selectively to the heating elements to cause the heating elements to generate heat, and carry out printing by heating the printing medium with the heat generated, wherein the first temperature sensor and the second temperature sensor are arranged to sandwich the conveyance path.

12. The printing apparatus according to claim 11, wherein the printing medium is continuous.

13. The printing apparatus according to claim 11, wherein the second temperature sensor is provided on an upstream side of the heating elements in the conveyance path.

14. The printing apparatus according to claim 11, wherein the second temperature sensor is provided within a width of the thermal head, with respect to the arrangement direction.

15. The printing apparatus according to claim 11, further comprising a heat sink provided on the substrate and configured to release the heat of the heating elements, wherein the first temperature sensor is provided on one of the substrate and the heat sink.

16. A printing apparatus, comprising:

a main-body having a space at an interior thereof;

a thermal head arranged on a substrate provided in the space, the thermal head having heating elements arranged along an arrangement direction;

a conveyor configured to convey a printing medium along a conveyance path, the conveyance path being provided in the space and intersecting with the arrangement direction;

a first temperature sensor provided in the space to face a first surface of the printing medium being conveyed by the conveyor;

a second temperature sensor provided in the space to face a second surface of the printing medium being conveyed by the conveyor, the second surface being opposite to the first surface; and a processor configured to:

correct an amount of applying energy to be applied to the heating elements, based on a first temperature detected by the first temperature sensor and a second temperature detected by the second temperature sensor; and apply a corrected amount of the applying energy selectively to the heating elements to cause the heating elements to generate heat, and carry out printing by heating the printing medium with the heat generated.

17. The printing apparatus according to claim 16, further comprising a supporting portion provided in the space and configured to support a supply source of the printing medium, wherein the printing medium is continuous.

18. The printing apparatus according to claim 16, wherein the second temperature sensor is provided on an upstream side of the heating elements in the conveyance path.

19. The printing apparatus according to claim 16, wherein the second temperature sensor is provided within a width of the thermal head, with respect to the arrangement direction.

20. The printing apparatus according to claim 16, further comprising a heat sink provided on the substrate and configured to release the heat of the heating elements, wherein the first temperature sensor is provided on one of the substrate and the heat sink.

* * * * *